US011085722B2

(12) United States Patent
Aaronson

(10) Patent No.: US 11,085,722 B2
(45) Date of Patent: Aug. 10, 2021

(54) TRIGGER SAFETY SYSTEM AND METHOD OF USE

(71) Applicant: Scott Aaronson, Southfield, MI (US)

(72) Inventor: Scott Aaronson, Southfield, MI (US)

( * ) Notice: Subject to any disclaimer, the term of this patent is extended or adjusted under 35 U.S.C. 154(b) by 0 days.

(21) Appl. No.: 16/898,442

(22) Filed: Jun. 11, 2020

(65) Prior Publication Data

US 2020/0393210 A1 Dec. 17, 2020

Related U.S. Application Data

(60) Provisional application No. 62/860,576, filed on Jun. 12, 2019.

(51) Int. Cl.
*F41A 17/46* (2006.01)
*F41A 17/54* (2006.01)
*F41A 19/10* (2006.01)

(52) U.S. Cl.
CPC ..... *F41A 17/54* (2013.01); *F41A 19/10* (2013.01)

(58) Field of Classification Search
CPC ..... F41A 17/46; F41A 17/48; F41A 17/08
See application file for complete search history.

(56) References Cited

U.S. PATENT DOCUMENTS 4,422,254 A * 12/1983 McQueen ..... F41A 17/56 42/70.05
8,713,836 B1 * 5/2014 Haq ..... F41A 17/46 42/70.06
2017/0370668 A1 * 12/2017 Locher ..... F41A 17/46
2018/0238651 A1 * 8/2018 Kilic ..... F41A 17/46

* cited by examiner

*Primary Examiner* — J. Woodrow Eldred

(57) ABSTRACT

A trigger safety system is presented herein. The trigger safety system provides a weight pawl with a rotor that precisely blocks a trigger of a firearm from activating when the firearm is pointed toward the ground and/or pointed downward. In this way, the trigger safety system presented herein prevents those at a firing range, or those in training, or at other locations from shooting projectiles in undesirable directions. Additionally, the disclosure herein presents a biometric safety system that can be retrofit onto a variety of trigger activated devices for safety measures.

19 Claims, 19 Drawing Sheets

TRIGGER SAFETY SYSTEM AND METHOD OF USE

CROSS-REFERENCE TO RELATED APPLICATIONS

The present application claims priority to U.S. Provisional Patent Application No. 62/860,576 which was filed on Jun. 12, 2019, which is hereby incorporated by reference herein in its entirety, including any figures, tables, or drawings.

FIELD OF THE DISCLOSURE

This disclosure relates to a trigger safety system and method of use. More specifically and without limitation, this disclosure relates to a trigger safety system for preventing accidental discharge of a weapon, and related method of use.

COPYRIGHT NOTICE

At least a portion of the disclosure of this patent document contains material that is subject to copyright protection. The copyright owner has no objection to the facsimile reproduction by anyone of the patent document or the patent disclosure, as it appears in the Patent and Trademark Office patent files and/or records, but otherwise reserves all copyright rights whatsoever. The following notice applies to the software and data as described below and in the drawings that form a part of this document: Copyright Scott Aaronson. All rights reserved.

BACKGROUND OF THE DISCLOSURE

This disclosure relates to gun safety. More specifically, and without limitation, this disclosure relates to a trigger safety mechanism which disrupts the trigger activation pathway such that a firearm and/or handgun may not discharge because the trigger pathway of the device is blocked by the safety mechanism. More specifically, and without limitation, this disclosure relates to a trigger safety mechanism activated by gravity, such that the trigger safety mechanism is activated when a firearm and/or handgun is in a vertical position; or in other words pointed downward. In this way, the safety mechanism disclosed herein prevents unwanted discharge (negligent and/or accidental) of a firearm, handgun, and/or other trigger activated device which has been equipped and/or retrofitted with the trigger safety mechanism disclosed herein.

Unintentional discharge (of a firearm) is the event when a firearm discharges at a time not intended by the user. An unintended discharge may be produced by a mechanical malfunction such as a slamfire and/or related issue as well as a negligent discharge induced due to training issues, or a simple accident. Additionally, a person not the user may discharge another's weapon intentionally without the user approving, when the weapon is in a vertical position, such as when the weapon is in a bolster or to the side or down in front of a user. Any activation of a dangerous weapon by means of the trigger that results in the unplanned discharge is outside of a firearm's prescribed use and/or purpose. Prescribed and/or intended uses of firearms do not include accidental discharges.

Accidental discharge of a trigger is when a trigger is pulled for a purpose other than shooting at a target. Examples of accidental discharge include some intentional accidental discharge scenarios, but are not limited to, dry-fire practice, demonstration, or function testing. In the event of an accidental discharge, ammunition is unintentionally discharged from the trigger device by the activation of the trigger.

Negligent discharge is when a user places their finger on the trigger before and/or after they have decided to shoot at a target. With the finger of a user positioned on a trigger, many activities can be the cause of a negligent discharge. Any activity which inadvertently activates the trigger can be the cause of a negligent discharge. As one example, but not limiting the events of negligent discharge, if one attempts to holster a firearm with a finger on the trigger, the holster edge will drive the finger forcefully on the trigger, and discharge is likely to occur. Additionally, other parts of a holster or surrounding features could press the trigger, causing discharge of the firearm. As another example, a trigger activated device may activate if a user stumbles or in the event of struggle, with an adversary such as one a police officer or military personnel may encounter. Any other events of negligent discharge in which a trigger is compressed when trigger compression is undesired may be a negligent discharge and are likely highly undesirable, especially in the case of firearms which can cause severe injury and even death in the event of negligent discharge.

In the case of firearms, gun safety rules recognize the above possibilities, and aim to prevent them. The number 1 rule of gun safety is to always keep the firearm pointed in a safe direction. Usually, this direction is down. The number 2 rule of gun safety is not to place a finger inside the trigger guard area until the decision has been made to fire the weapon. This rule isn't always followed. In fact, many training scenarios require the finger to be on or near the trigger such that quicker firing decisions can be made. Additionally, if hostiles and/or adversaries are being faced by a user, then one must be prepared to fire at a moments notice and can not follow the second rule of gun safety. Furthermore, a stumble or tussle with an adversary, even if the gun is in a holster, does not prevent the adversary from activating the trigger mechanism, compressing the trigger, which creates negligent discharge and can severely injure or kill the holder.

The disclosure herein, aims to provide a mechanism which can be retrofit to any trigger activated device and prevent both accidental and negligent discharge, thus improving upon the safety of a user and those around the user.

SUMMARY OF THE DISCLOSURE

A trigger safety mechanism and method of use are presented herein. More specifically and without limitation, this disclosure relates to a trigger safety mechanism for preventing accidental discharge of a weapon, and related method of use.

The disclosure presented herein relates to a safety mechanism to prevent accidental discharge of a gun and/or projectile launcher, and/or other trigger device. Other examples of trigger devices include, but are not limited to, spray painters, hose handles, nail guns, air guns, and or other projectile launchers or substance launchers for which accidental discharge wants to be prevented.

In the example of a firearm, the disclosure herein relates to a trigger safety mechanism which prevents discharge of a firearm when the firearm is in a vertical, and or downward pointing position. An example of when a firearm is in a downward position includes, but is not limited to, when a gun is in a holster, when a firearm is pointed downward during a training exercise, when a firearm is pointed downward during an exploration, and other situations. In addition, the safety device can prevent improper discharge during a conflict situation where the handgun is in a holster and an unwanted individual discharges the weapon without the authorization of the owner and/or user of the firearm.

The disclosure presented herein uses a weighted mechanism that can be attached and/or removed from and/or fit and/or retrofit to any firearm and/or other trigger mechanism. The disclosure presented herein uses a gravity activated weighting system to block the trigger from movement in the direction which would activate the discharge of a firearm and/or other trigger powered mechanism.

Thus, this disclosure relates to gun safety, the automatic deactivation, and automatic activation of trigger systems for a trigger activated device based upon the devices orientation to gravitational forces. This disclosure relates to a safety mechanism capable of being retrofitted onto any handgun, firearm, and/or other trigger activated devices. This disclosure relates to preventing accidental discharge and/or unauthorized use of handguns, firearms, and/or other trigger activated devices. The disclosure utilizes gravitational forces, among other forces, for activating and deactivating a safety mechanism.

Thus, it is a primary object of the disclosure to provide a trigger safety system and method of use that improves upon the state of the art.

Another object of the disclosure is to provide a trigger safety system and method of use that is safe.

Yet another object of the disclosure is to provide a trigger safety system and method of use that can fit on any handgun, firearm, and/or other trigger activated device.

Another object of the disclosure is to provide a trigger safety system and method of use that is easy to use.

Yet another object of the disclosure is to provide a trigger safety system and method of use that is accurate.

Another object of the disclosure is to provide a trigger safety system and method of use that is reliable.

Yet another object of the disclosure is to provide a trigger safety system and method of use that improves the safety of gun related activities.

Another object of the disclosure is to provide a trigger safety system and method of use that is durable.

Yet another object of the disclosure is to provide a trigger safety system and method of use that prevents discharge of a firearm when the firearm is in a vertical or near vertical position.

Another object of the disclosure is to provide a trigger safety system and method of use that is small.

Yet another object of the disclosure is to provide a trigger safety system and method of use that is lightweight.

Another object of the disclosure is to provide a trigger safety system and method of use that can be replaced easily.

Yet another object of the disclosure is to provide a trigger safety system and method of use that is high quality.

Another object of the disclosure is to provide a trigger safety system and method of use that can be retrofit to almost any firearm.

Yet another object of the disclosure is to provide a trigger safety system and method of use that can block the trigger action of a trigger activated mechanism.

Another object of the disclosure is to provide a trigger safety system and method of use that prevents accidental discharge.

Yet another object of the disclosure is to provide a trigger safety system and method of use that will perform in stressful situations.

These and other objects, features, or advantages of the present disclosure will become apparent from the specification and claims.

DETAILED DESCRIPTION OF THE DISCLOSURE

Figure 1:
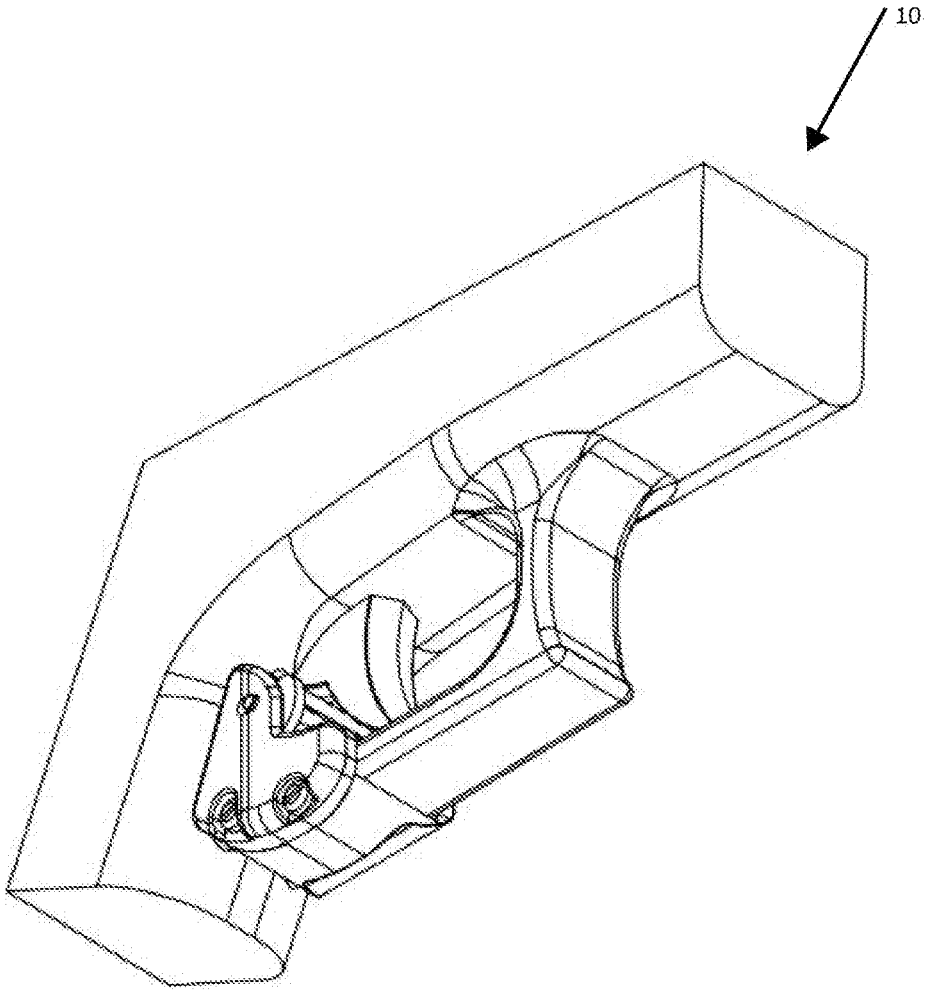
FIG. 1 is a bottom, perspective view of the trigger safety system; the view showing the safety system; the view showing a partial firearm apparatus; the view showing the housing of the system; the view showing the clamp assembly engaged and holding the system together, the view showing the pawl in a disengaged position.
Figure 2:
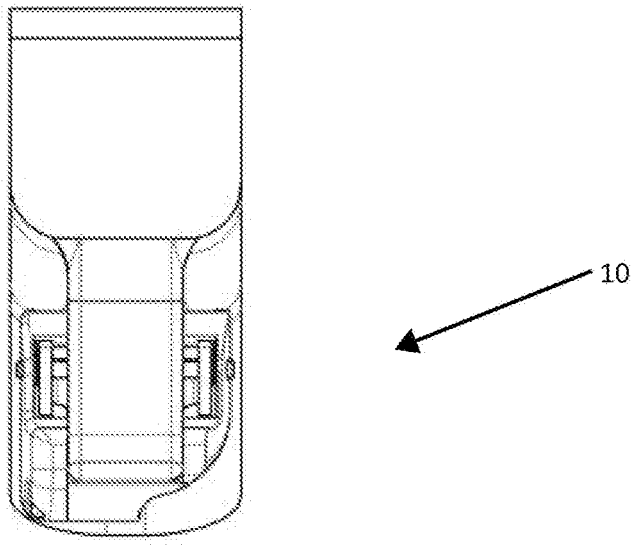
FIG. 2 is a front, elevation view of the trigger safety system; the view showing the safety system; the view showing a partial firearm apparatus; the view showing the housing of the system; the view showing the clamp assembly engaged and holding the system together; the view showing the pawl in a disengaged position.
Figure 3:
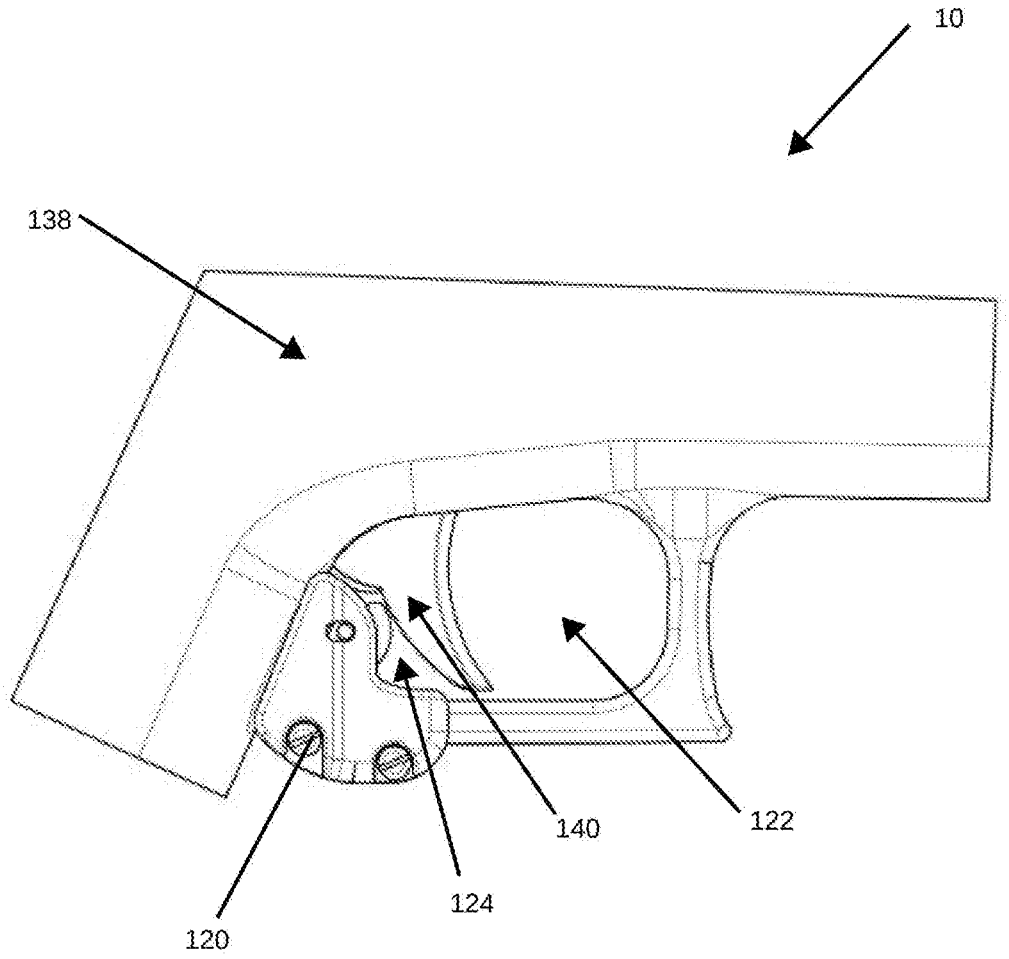
FIG. 3 is a side, elevation view of the trigger safety system; the view showing the safety system; the view showing a partial firearm apparatus; the view showing the housing of the system; the view showing the clamp assembly engaged and holding the system together; the view showing the pawl in a disengaged position.
Figure 4:
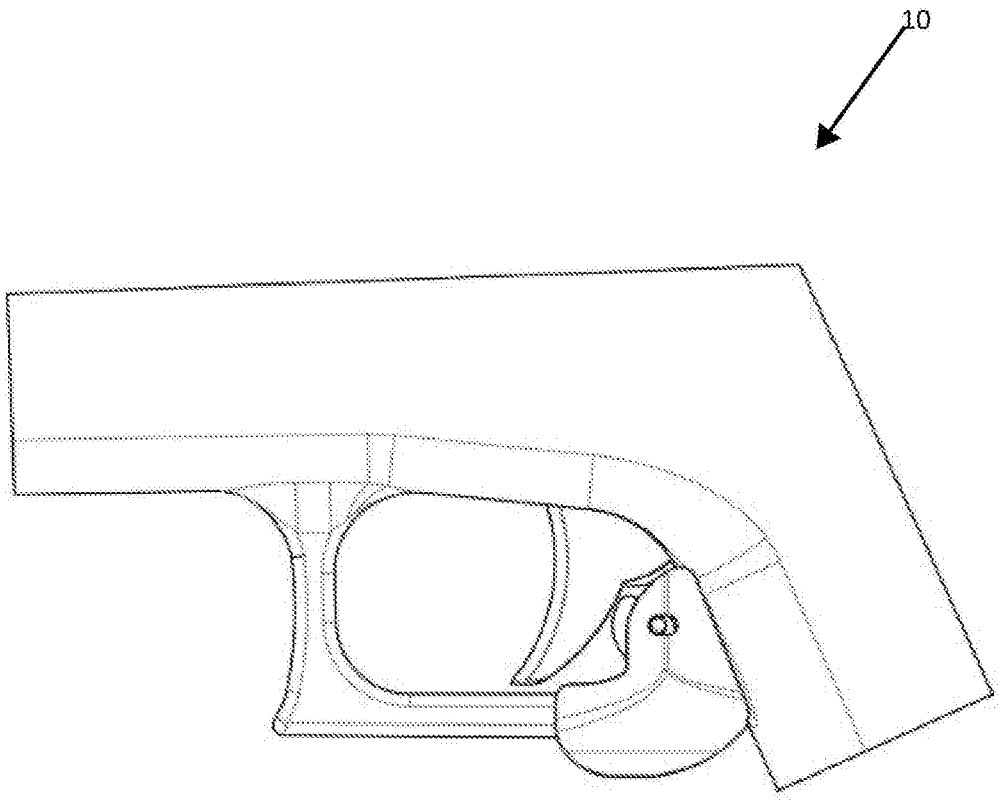
FIG. 4 is a side, elevation view of the trigger safety system; the view showing the safety system; the view showing a partial firearm apparatus; the view showing the housing of the system; the view showing the clamp assembly engaged and holding the system together; the view showing the pawl in a disengaged position.
Figure 5:
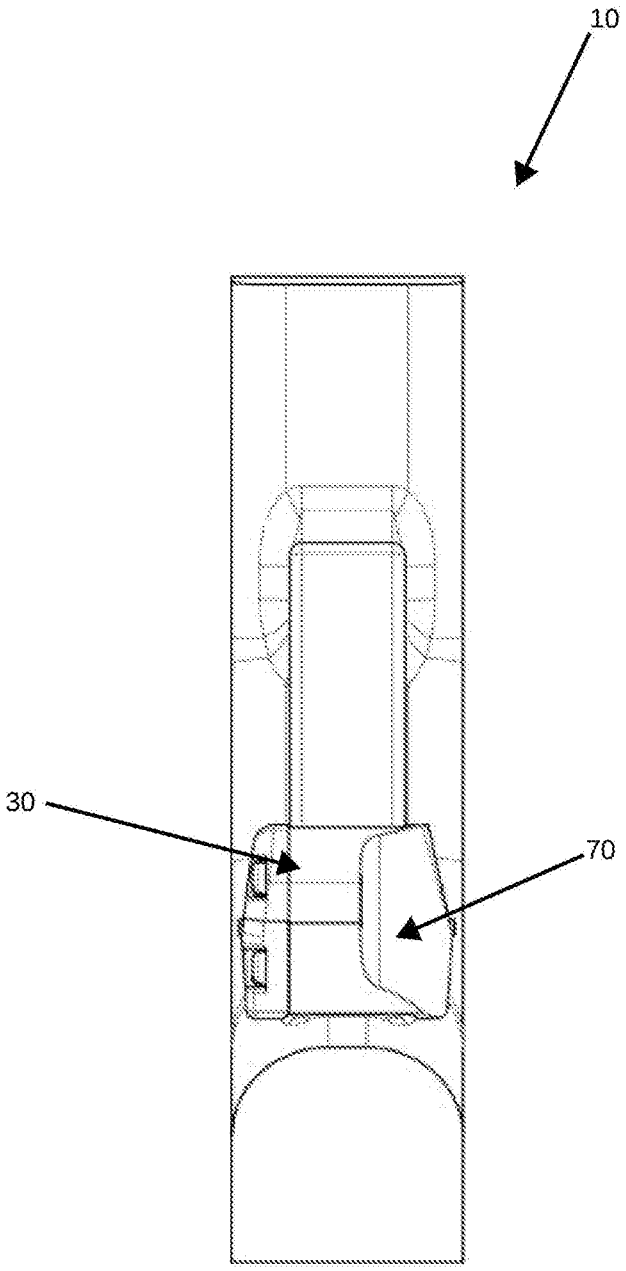
FIG. 5 is a bottom view of the trigger safety system; the view showing the safety system; the view showing a partial firearm apparatus; the view showing the housing of the system; the view showing the clamp assembly engaged and holding the system together; the view showing the pawl in a disengaged position.
Figure 6:
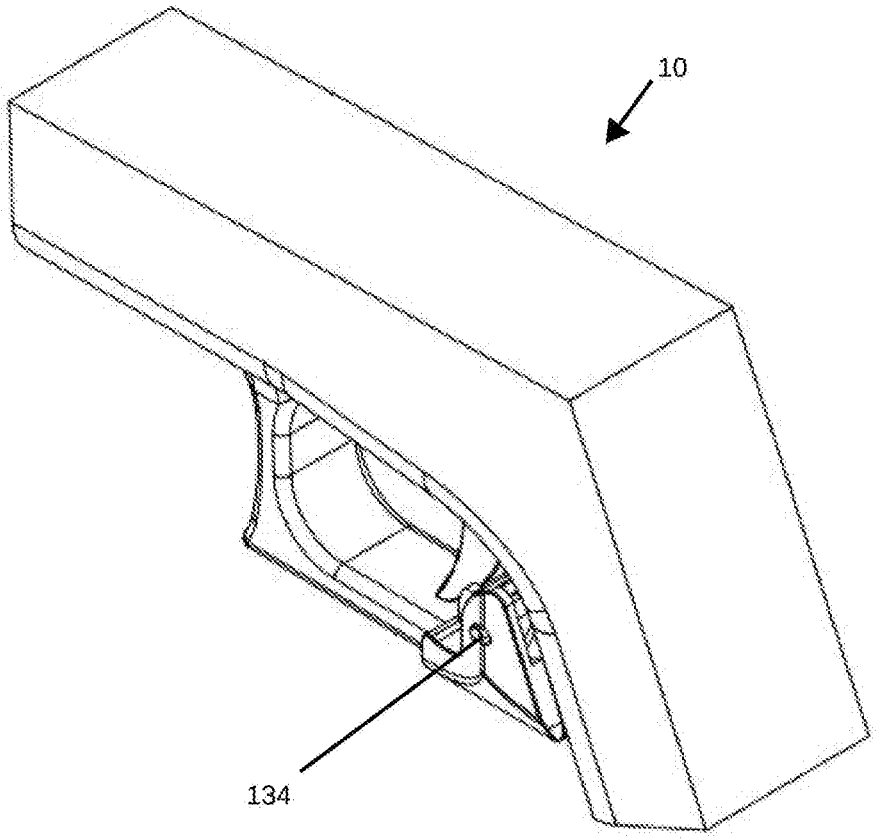
FIG. 6 is a top, perspective view of the trigger safety system; the view showing the safety system; the view showing a partial firearm apparatus; the view showing the housing of the system; the view showing the clamp assembly engaged and holding the system together; the view showing the pawl in a disengaged position.
Figure 7:
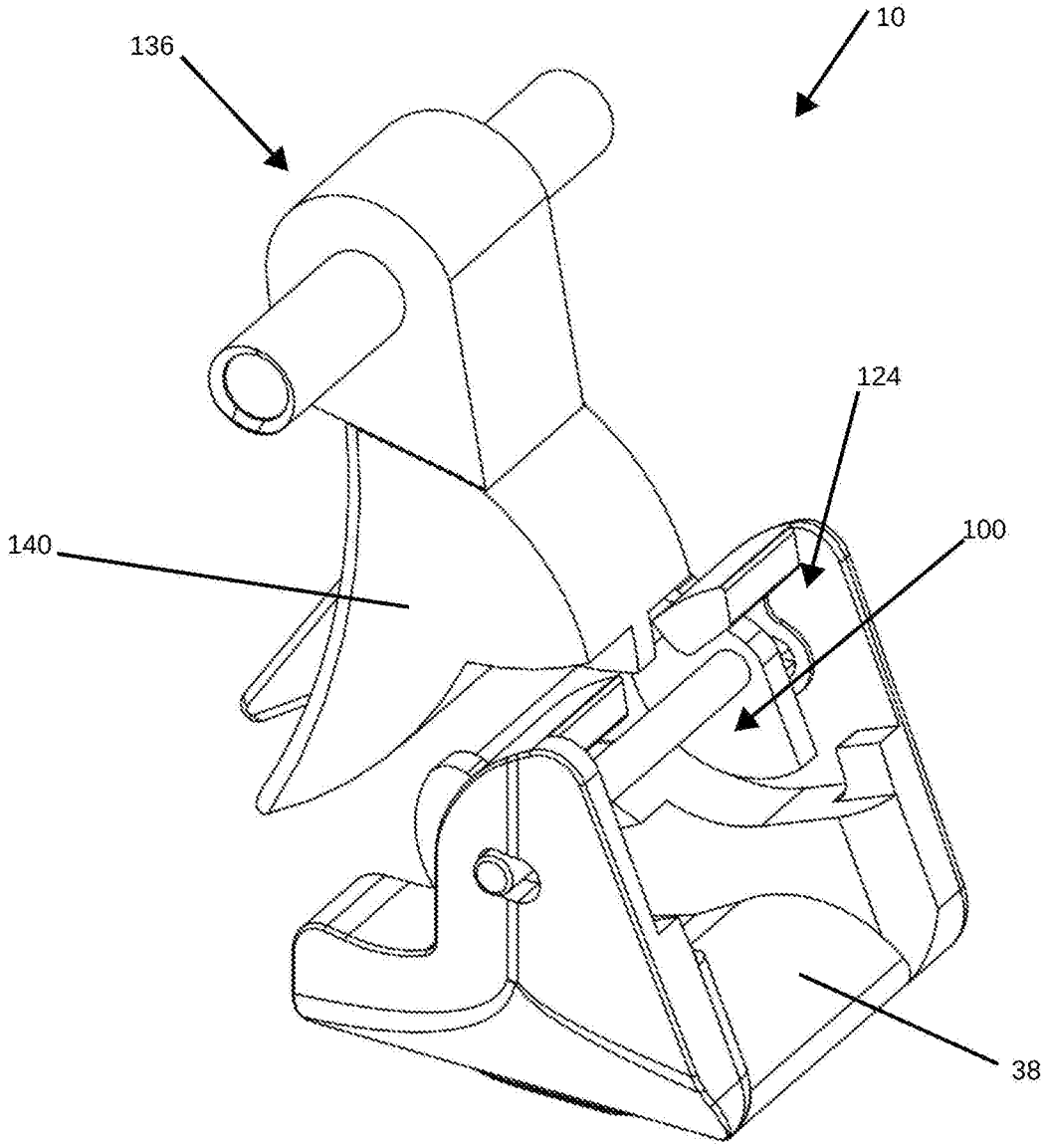
FIG. 7 is a top, perspective view of the trigger safety system; the view showing the trigger safety system detached from the trigger system; the view showing the safety system; the view showing the housing of the system; the view showing the clamp assembly engaged and holding the system together; the view showing the pawl in a disengaged position; the view showing the pawl with a swing radius; the view showing an indicator.
Figure 8:
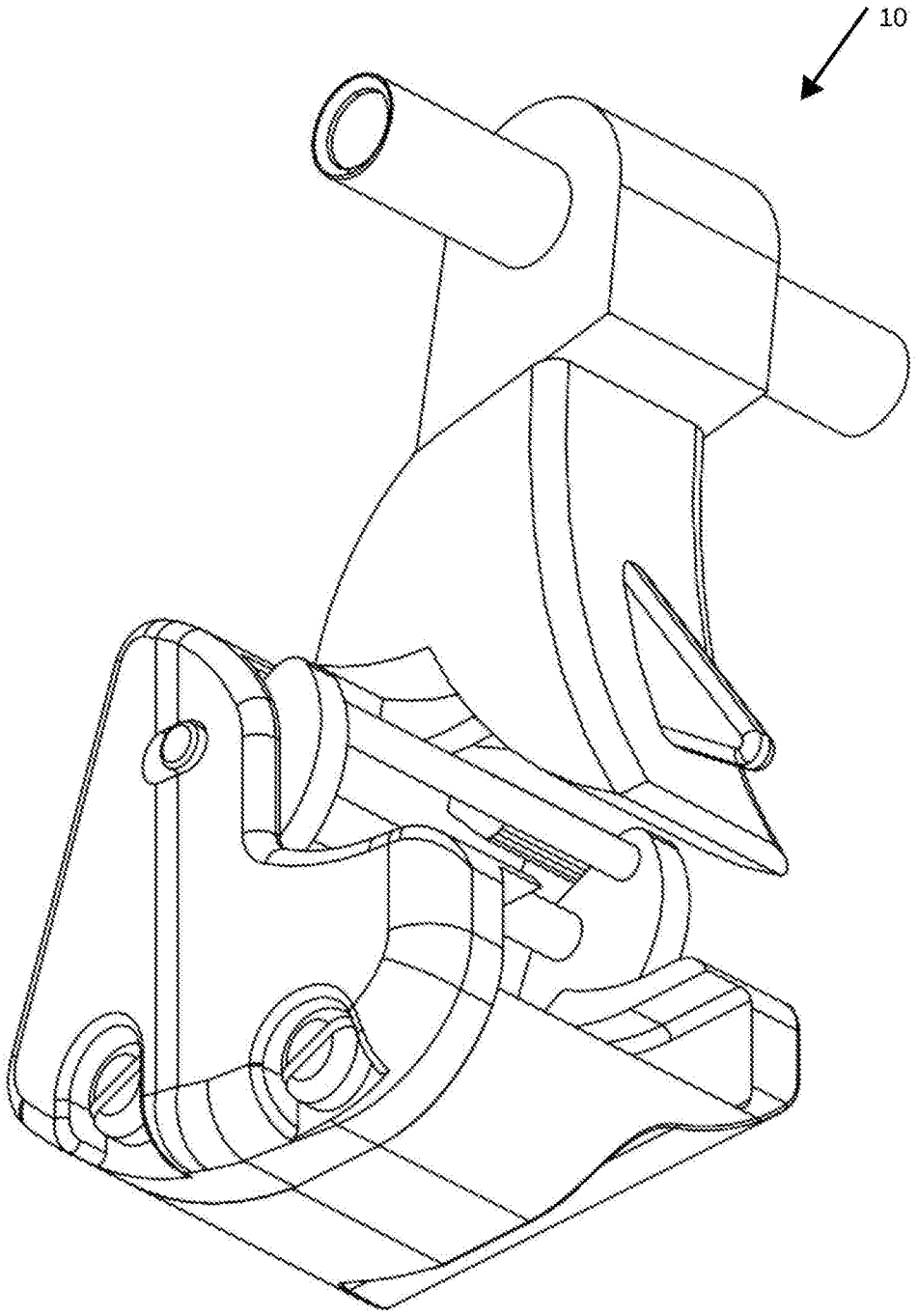
FIG. 8 is a bottom, perspective view of the trigger safety system; the view showing the trigger safety system detached from the trigger system; the view showing the safety system; the view showing the housing of the system; the view showing the clamp assembly engaged and holding the system together; the view showing the pawl in a disengaged position; the view showing the pawl with a swing radius; the view showing an indicator.
Figure 9:
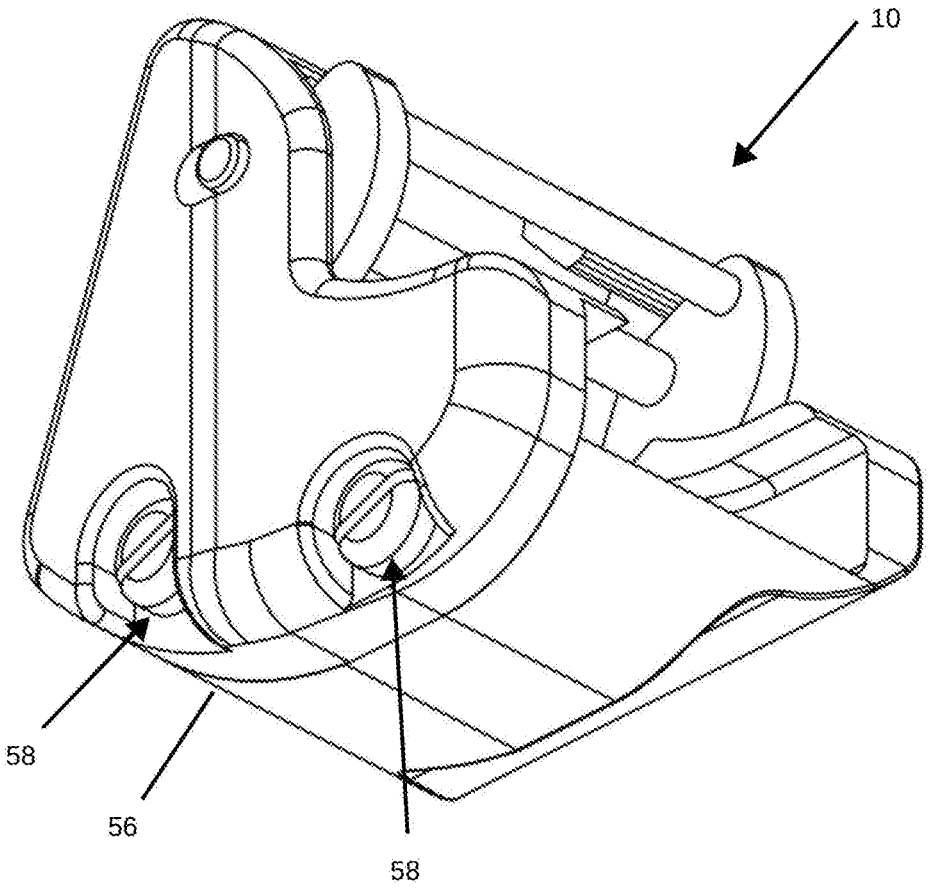
FIG. 9 is a bottom perspective view of the trigger safety system; the view showing the trigger safety system detached from the trigger system; the view showing the safety system; the view showing the housing of the system; the view showing the clamp assembly engaged and holding the system together; the view showing the pawl in an engaged position; the view showing the pawl with a swing radius; the view showing an indicator; the view showing attachment features.
Figure 10:
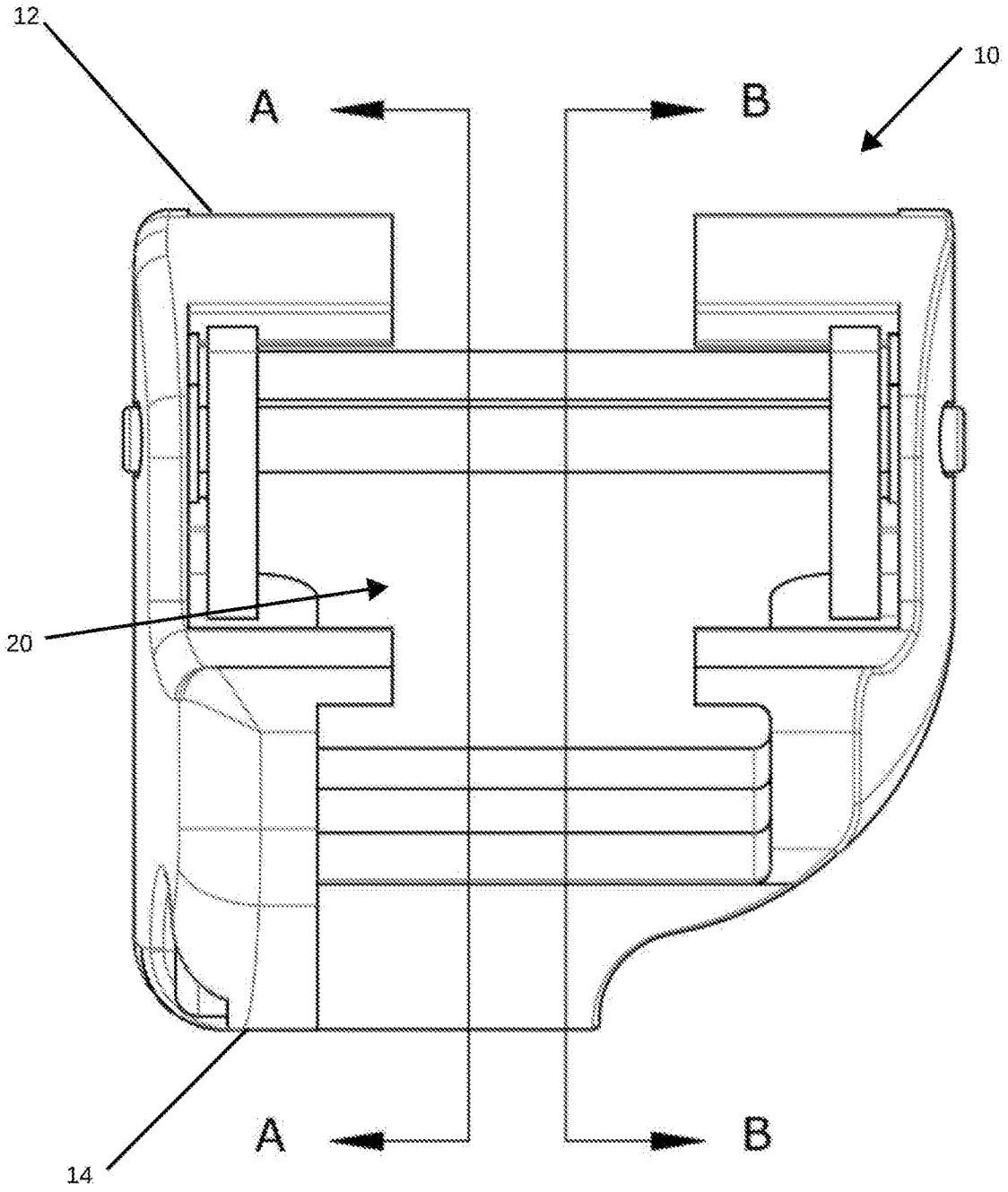
FIG. 10 is a front, elevation view of the trigger safety system; the view showing the safety system; the view showing the housing of the system; the view showing the clamp assembly engaged and holding the system together; the view showing the pawl in an engaged position; the view showing the pawl with a swing radius; the view showing an indicator; the view showing attachment features; the view showing reference to section view A which is shown in FIG. 18; the view showing reference to section view B which is shown in FIG. 19.
Figure 11:
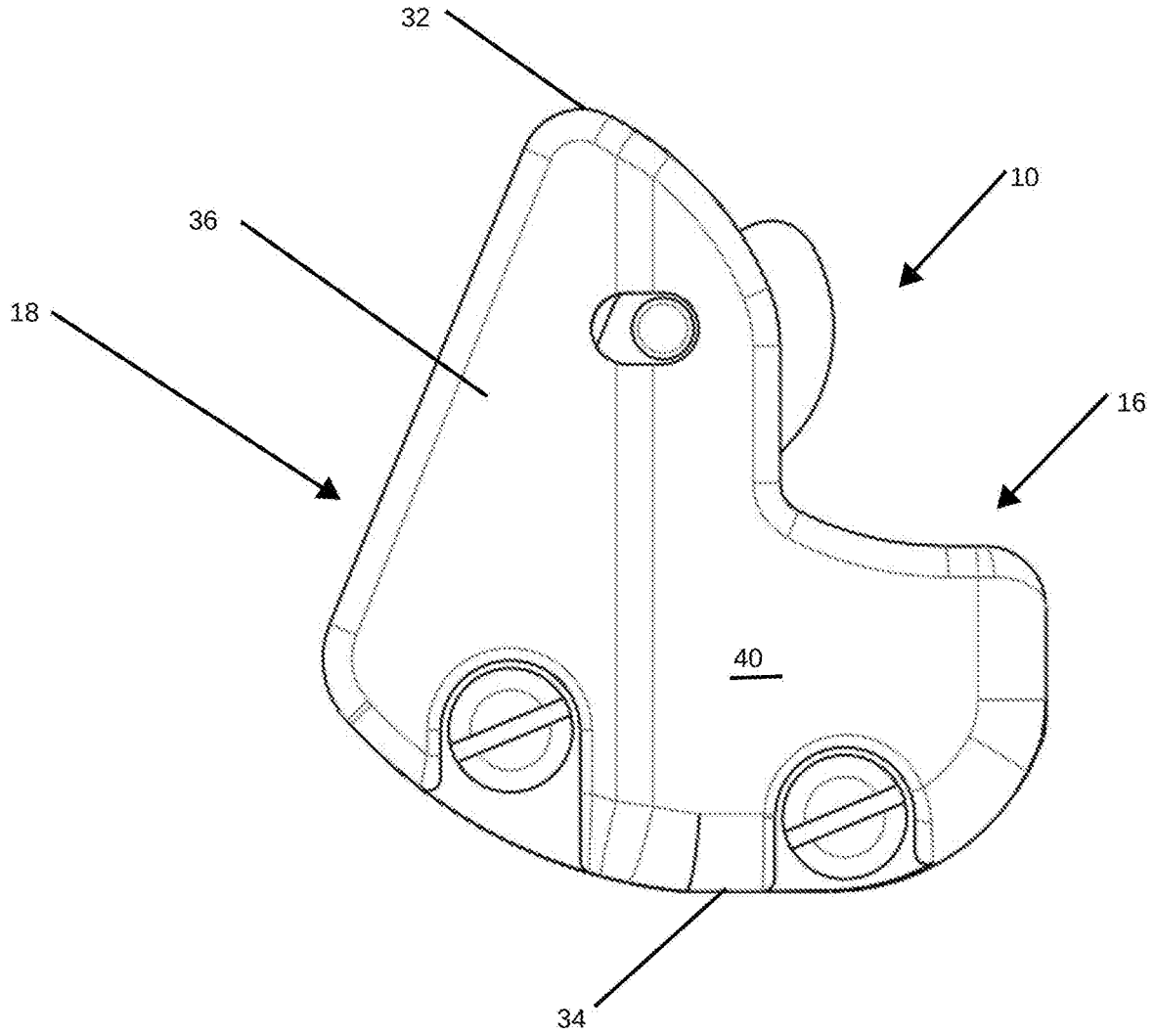
FIG. 11 is a side, elevation view of the trigger safety system; the view showing the safety system; the view showing the housing of the system; the view showing the clamp assembly engaged and holding the system together; the view showing the pawl in an engaged position; the view showing the pawl with a swing radius; the view showing an indicator; the view showing attachment features.
Figure 12:
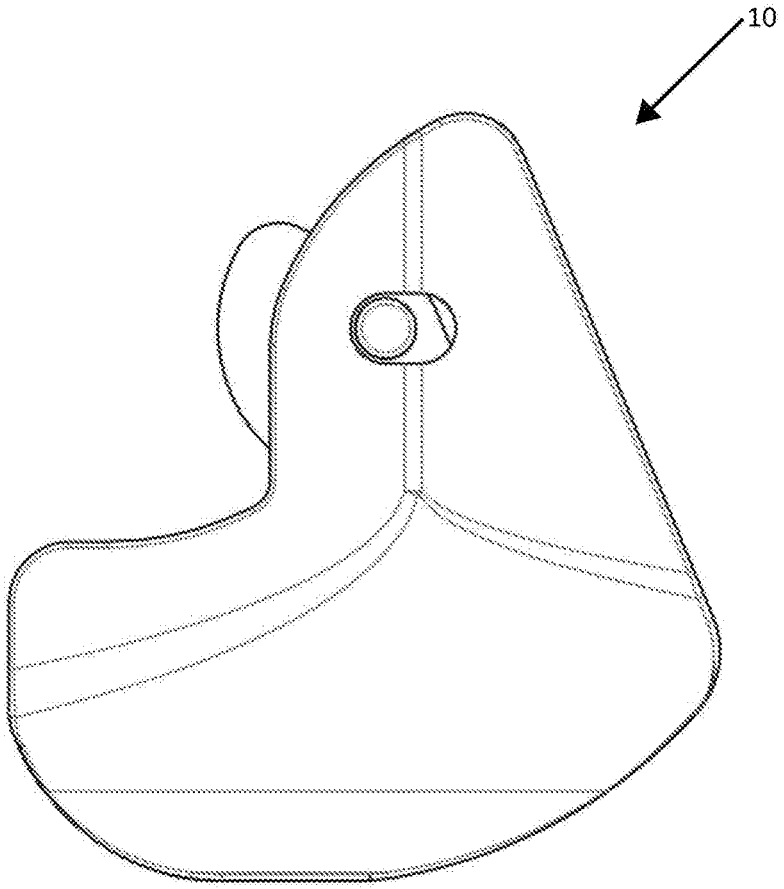
FIG. 12 is a side, elevation view of the trigger safety system; the view showing the safety system; the view showing the housing of the system; the view showing the clamp assembly engaged and holding the system together; the view showing the pawl in an engaged position; the view showing the pawl with a swing radius; the view showing an indicator; the view showing attachment features.
Figure 13:
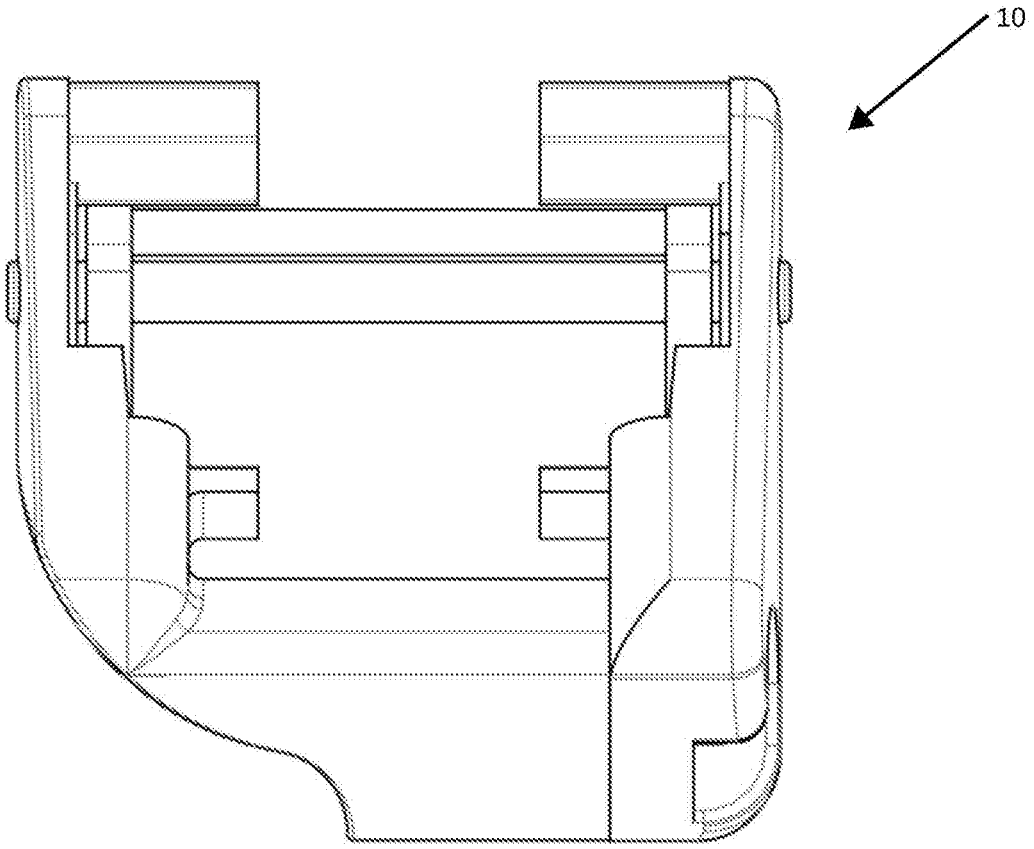
FIG. 13 is a rear, elevation view of the trigger safety system; the view showing the safety system; the view showing the housing of the system; the view showing the clamp assembly engaged and holding the system together; the view showing the pawl in an engaged position; the view showing the pawl with a swing radius; the view showing an indicator; the view showing attachment features.
Figure 14:
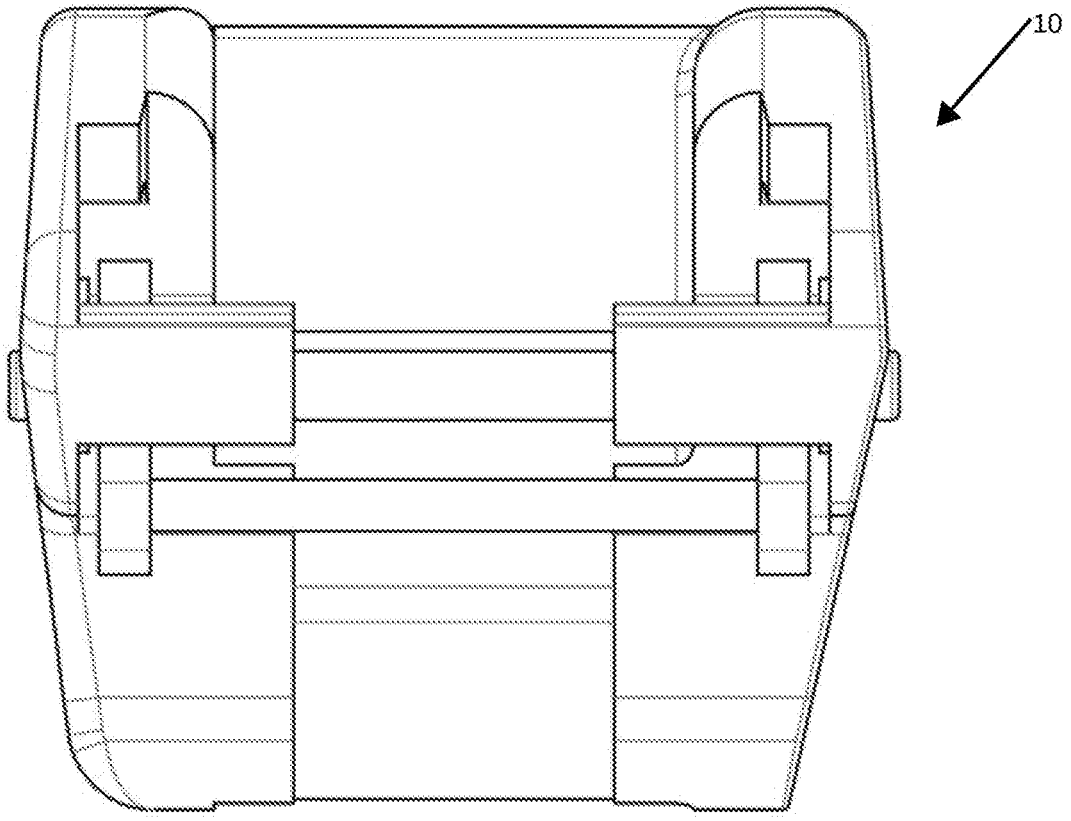
FIG. 14 is a top view of the trigger safety system; the view showing the safety system; the view showing the housing of the system; the view showing the clamp assembly engaged and holding the system together; the view showing the pawl in an engaged position; the view showing the pawl with a swing radius; the view showing an indicator; the view showing attachment features.
Figure 15:
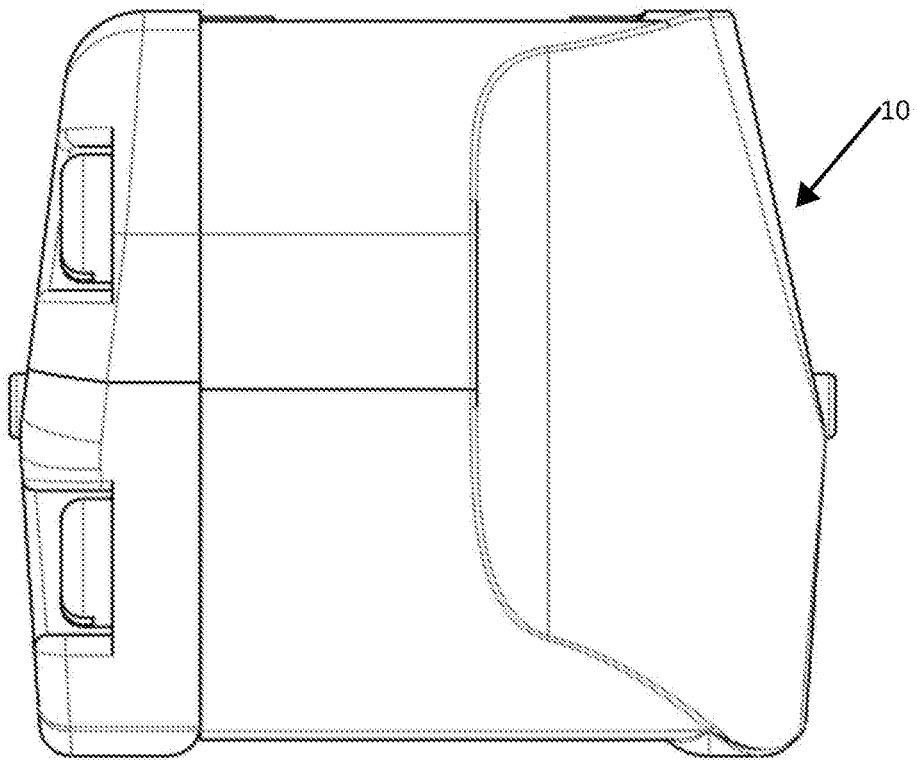
FIG. 15 is a bottom view of the trigger safety system; the view showing the safety system; the view showing the housing of the system; the view showing the clamp assembly engaged and holding the system together; the view showing the pawl in an engaged position; the view showing the pawl with a swing radius; the view showing an indicator; the view showing attachment features.
Figure 16:
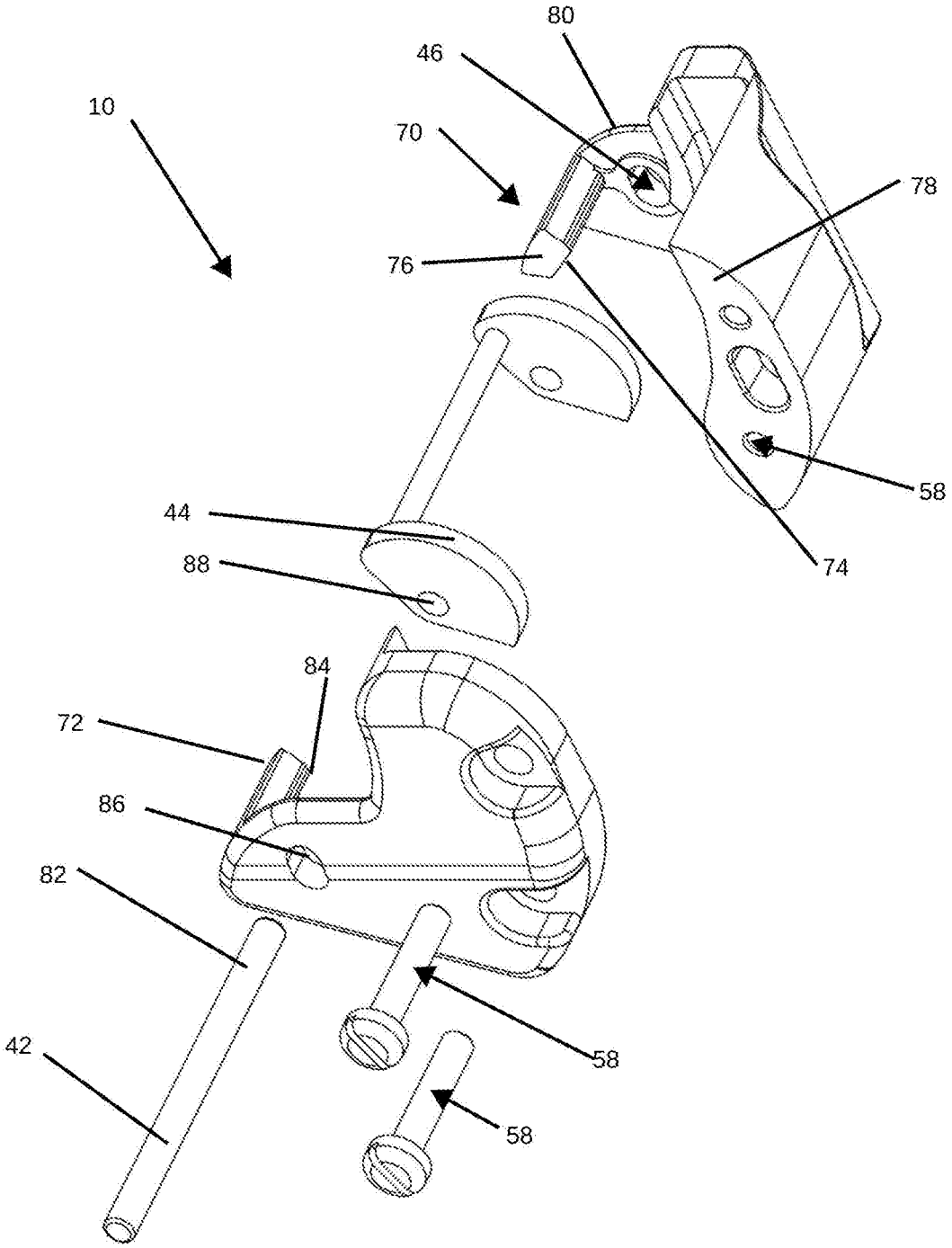
FIG. 16 is an exploded, isometric view of the trigger safety system; the view showing the trigger safety system; the view showing the housing of the trigger safety system; the view showing th clamp assembly; the view showing attachment features; the view showing the pawl system; the view showing a pin of the pawl system; the view showing a plurality of rotors with the pawl system; the view showing a plurality of attachment features; the view showing an indicator.
Figure 17:
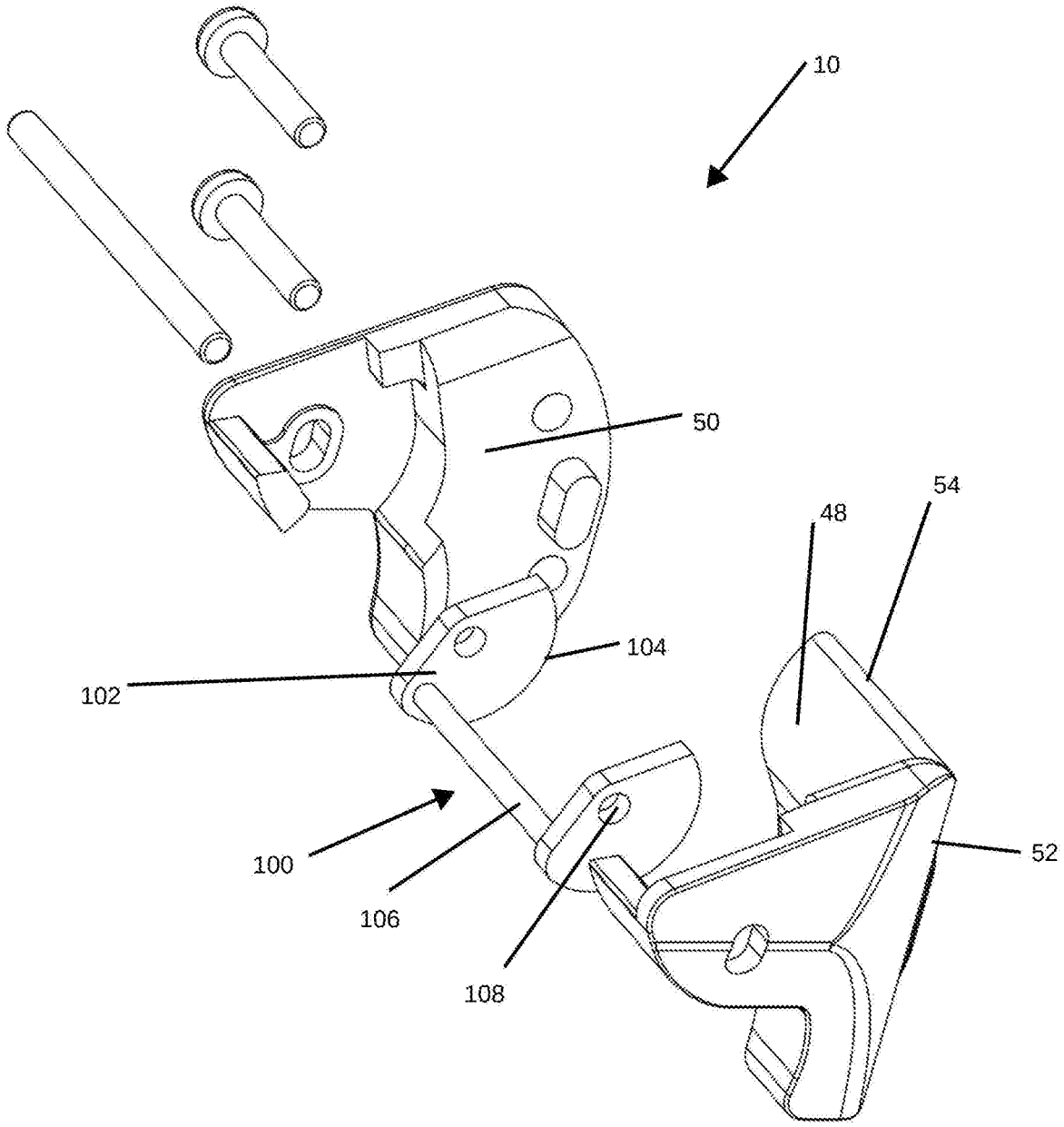
FIG. 17 is an exploded, isometric view of the trigger safety system; the view showing the trigger safety system; the view showing the housing of the trigger safety system; the view showing th clamp assembly; the view showing attachment features; the view showing the pawl system; the view showing a pin of the pawl system; the view showing a plurality of rotors with the pawl system; the view showing a plurality of attachment features; the view showing an indicator.
Figure 18:
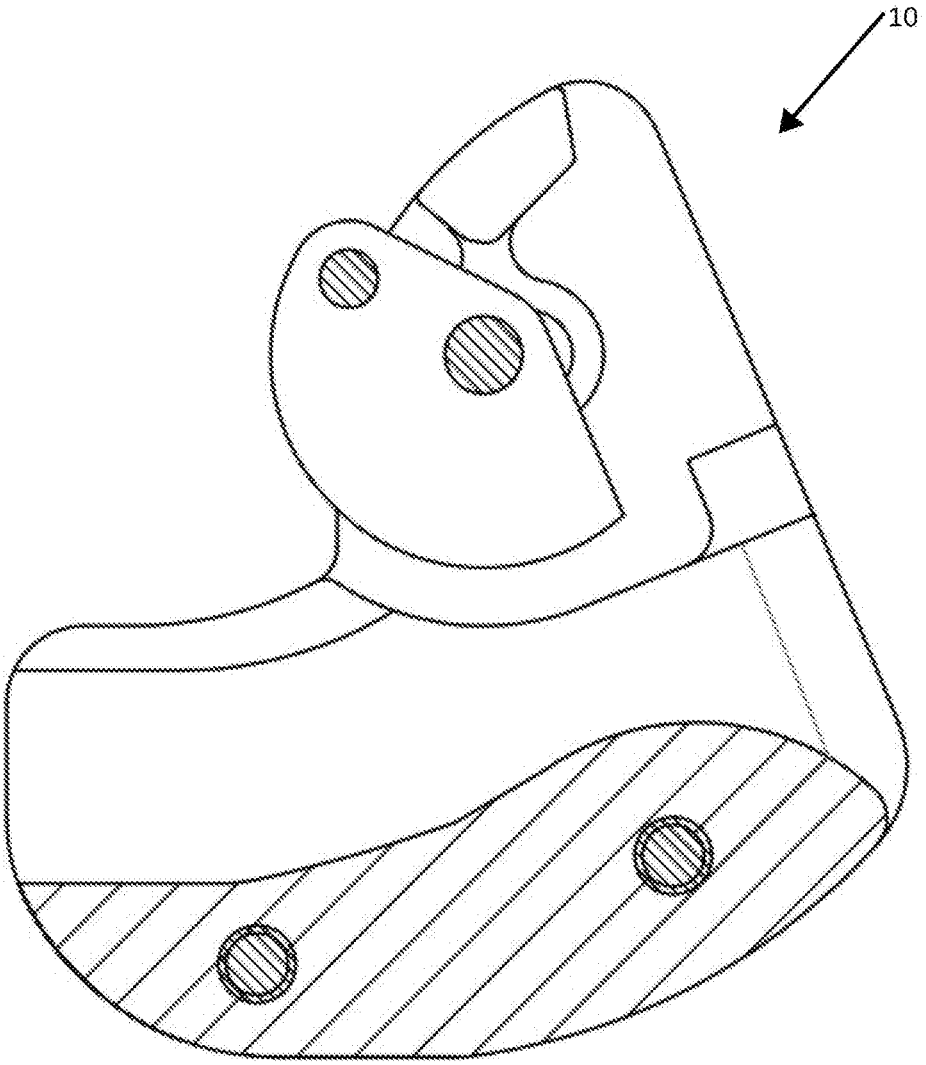
FIG. 18 is a section view of the trigger safety system; the view showing the trigger safety system; the view showing the housing of the trigger safety system; the view showing th clamp assembly; the view showing attachment features; the view showing the pawl system; the view showing a pin of the pawl system; the view showing a plurality of rotors with the pawl system; the view showing a plurality of attachment features; the view showing an indicator.
Figure 19:
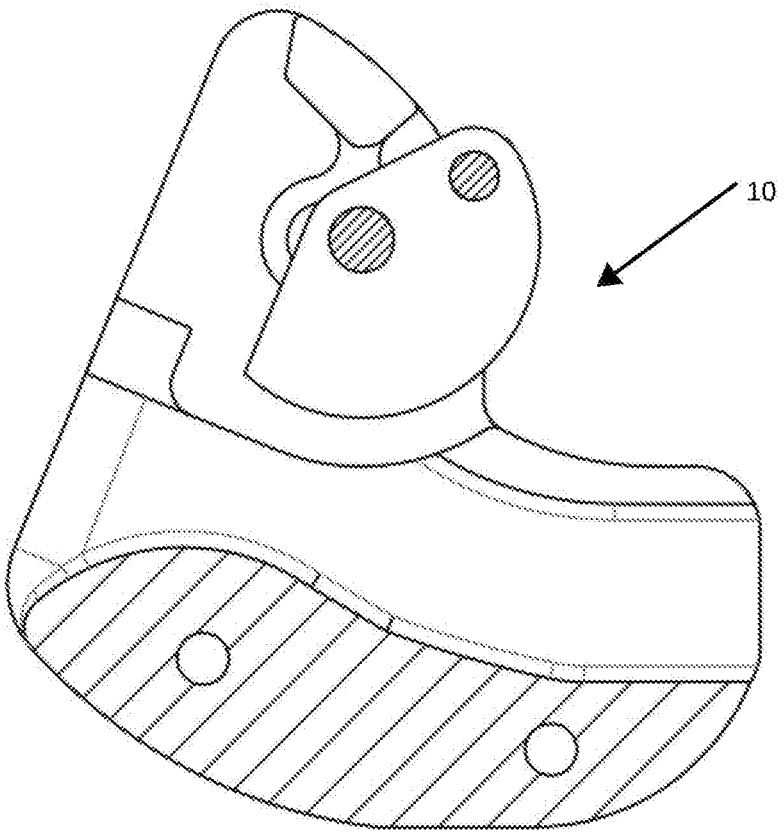
FIG. 19 is a section view of the trigger safety system; the view showing the trigger safety system; the view showing the housing of the trigger safety system; the view showing th clamp assembly; the view showing attachment features; the view showing the pawl system; the view showing a pin of the pawl system; the view showing a plurality of rotors with the pawl system; the view showing a plurality of attachment features; the view showing an indicator.

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the disclosure (s). The following detailed description is, therefore, not to be taken in a limiting sense, and the scope of the disclosure(s) is defined only by the appended claims, along with the full scope of equivalents to which such claims are entitled.

As used herein, the terminology such as vertical, horizontal, top, bottom, front, back, end, sides and the like are referenced according to the views, pieces and figures presented. It should be understood, however, that the terms are used only for purposes of description, and are not intended to be used as limitations. Accordingly, orientation of an object or a combination of objects may change without departing from the scope of the disclosure.

System:

With reference to the figures, a trigger safety system 10 is presented. Trigger safety system 10 is formed of any suitable size, shape and design. In the arrangement shown, as one example, trigger safety system 10 includes a housing 30, a clamp 70, and a pawl 100, among other components.

In the arrangement shown, as one example, system 10 is generally a rectangular shape when viewed from the front with a top 12, a bottom 14, a front 16, a back 18, and a hollow interior 20. In the arrangement shown, as one example, system 10 is sized, shaped, and designed to attach to a firearm at the rear side of the trigger such that the safety mechanism can block a trigger pathway so that the safety mechanism can prevent a firearm discharge when the firearm is pointed downward.

Housing:

In the arrangement shown, as one example, system 10 includes a housing 30. Housing 30 is formed of any suitable size, shape, and design and is configured to provide the main support and features of the system 10. Housing is also formed to accept and or receive other components of system 10, including but not limited to, a clamp 70 and a pawl 100.

In the arrangement shown, as one example, housing 30 forms approximately half of the rectangle of system 10, when viewed from the front. In this way, housing 30 is part of the system which attaches to a firearm or other trigger activated device. In the arrangement shown, as one example, housing 30, includes a top 32, a bottom 34, a sidewall 36, an interior surface 38 of sidewall 36, an exterior surface 40 of sidewall 36, a pin 42, a cam surface 44, a connecting feature 46, a bottom wall 48, an interior surface 50 of the bottom wall 48, an exterior surface 52 of the bottom wall 48, a front 54 of the bottom wall 48, a back 56 of the bottom wall 48, and a plurality of attachment features 58.

In the arrangement shown, as one example, housing 30 includes a sidewall 36. Sidewall 36 is formed of any suitable size, shape, and design and is configured to support a pawl and connect the connecting feature 46 (or top wall) and the bottom wall 48. In the arrangement shown, as one example, sidewall 36 has an interior surface 38 which adjoins the hollow interior 20. Sidewall 36 has an exterior surface 40 on the outside of the sidewall 36. In this way, the interior surface 38 and the exterior surface 40 define the sidewall 36, which extends a length from a top to a bottom.

In the arrangement shown, as one example, sidewall 36 includes multiple features. These features include, but are not limited to, a pin 42 and a cam surface 44. Along the lower end or bottom of the sidewall 36 is a cam surface 44. In the arrangement shown, as one example, cam surface 44 is shaped generally like the rotor 102 of the pawl 100 such that the rotor 102 of the pawl 100 can rotate and/or move into and out of the hollow interior 20 without coming into contact with the cam surface 44. In the arrangement shown, as one example, the cam surface 44 is shaped such that the cam surface 44 does not contact the rotor 102 of the pawl 100 as the rotor 102 of the pawl 100 moves into and/or out of the hollow interior 20. However, it is hereby contemplated that the cam surface may cause friction with the rotor 102 of the pawl 100 such that the pawl 100 is slowed and/or subject to rigidity of motion by the cam surface 44.

In the arrangement shown, as one example, sidewall 36 also includes a pin 42. Pin 42 may be formed of any suitable size, shape and design and is configured to connect to the connecting feature 106 of the pawl 100. In the arrangement shown, as one example, pin 42 is a circular shaped extension which juts out into the hollow interior 20, away from the interior surface 38 of the sidewall 36. In other words, pin 42 is rod-like in shape and provides a small circular structure on which the connecting feature 106 of the pawl 100 can attach to the sidewall 36.

Nearer the top end of the sidewall 36 is a connecting feature 46. Connecting feature 46 may be formed of any suitable size, shape, and design and is configured to create a feature with which system 10 can be connected to a firearm and/or other trigger activated device. In the arrangement shown, as one example, connecting feature 46 extends perpendicularly from the top portion of sidewall 36. In this way connecting feature acts as an arm or attachment means by which the housing 30 can be operably attached to a trigger guard or other feature of a trigger activated device.

Nearer the bottom end of the sidewall 36 is a bottom wall 48 which extends inwardly in approximate parallel spaced relation to the connecting feature 46 of the sidewall 36. In the arrangement shown, as one example, bottom wall 48 extends perpendicularly from the bottom of sidewall 36. In this arrangement, as one example, bottom wall 48 extends a distance from the first end of bottom wall 48, where the bottom wall is connected to the sidewall 36 to a second end where the clamp 70 can be attached to the bottom wall 48.

In the arrangement shown, as one example, bottom wall 48 includes a plurality of features including, but not limited to, an interior surface 50, an exterior surface 52, a front 54, a back 56, and attachment features. In the arrangement shown, as one example, the interior surface 50 of the bottom wall 48 is curved such that the housing 30 fits smoothly against the bottom of a trigger guard. In other words, the smooth, curved surface of the interior portion of the bottom wall 48 allows for easy attachment and fitting of the housing 30 against the surface of a trigger guard and/or other trigger activated device. In this way, the housing 30 can be more easily removed and attached to various surfaces of various firearms, weapons, and/or various surfaces of various trigger activated devices. In the arrangement shown, as one example, the interior surface 50 of the bottom wall 48 is a plurality of cam surfaces such that the bottom wall fits with a handgun. However, various shapes and contours of the bottom wall 48, such that the bottom wall has an optimal fit for retro-fitting is hereby contemplated for use.

In the arrangement shown, as one example, bottom wall 48 includes a plurality of attachment features 58. Attachment features 58 are formed of any suitable size, shape, and design and are configured such that the clamp 70 can be easily attached to the housing 30. In the arrangement shown, as one example, attachment features 58 are found on the end of the bottom wall 48 furthest away from the sidewall 36 such that the clamp 70 can be directly attached to the housing 30. In the arrangement shown, as one example, attachment features 58 include a small boring into the housing 30 which is threaded. In this way a screw or other threaded attachment means can be used to attach the clamp 70 to the housing 30 by using a single screw and/or other threaded device. However, other attachment means and/or attachment features 58 which allow for quickly and easily attaching and detaching the clamp 70 from the housing 30 are hereby contemplated for use.

In the arrangement shown, as one example, the housing 30 is made from a single monolithic component. However, multiple operably connected components are hereby contemplated for use which may be connected by adhesion, jointing, fastening, and the like are hereby contemplated for use. In the arrangement shown, as one example, the housing 30 is made from a durable polymer. However, other materials which are adequate for a housing 30 are hereby contemplated for use. As an example, other materials may include a metal, a composite, an alloy, carbon fiber, polymers, enhanced polymers, pvc, ornamented wood, any combination thereof, and the like. Furthermore, various designs and shapes of the housing 30 are hereby contemplated for use. Various designs and shapes of housing are necessary to adapt to various shapes of trigger activated devices.

Clamp:

In the arrangement shown, as one example, system 10 includes a clamp 70. Clamp 70 is formed of any suitable size, shape, and design and is configured to attach to the housing 30 in a way that secures the housing and the remaining features of system 10 to a trigger activated device. Furthermore, in the arrangement shown, as one example, clamp 70 is designed in a way to be quickly and easily removed and re-attached to housing 30 such that system 10 can be removed and/or attached and/or easily retro-fit to various devices. In this way, system 10 can be used over and over again and even be used on varying devices.

In the arrangement shown, clamp 70 is shaped similarly to sidewall 36 such that clamp 70 in some ways mirrors sidewall 36. In other words, clamp 70 extends from a top 72 to a bottom 74 by a sidewall 76 which has an interior surface 78 and an exterior surface 80. In the arrangement shown, as one example, clamp 70 has a pin 82 which may be similar in design to the pin 42 of the sidewall 36. In this way, the housing 30 and the clamp 70 can accept and/or attach to a symmetrical pawl 100 and support the pawl 100.

In other words, in the arrangement shown as one example, clamp 70 includes a pin 82. Pin 82 may be formed of any suitable size, shape and design and is configured to connect to the connecting feature 106 of the pawl 100. In the arrangement shown, as one example, pin 82 is a circular shaped extension which juts out into the hollow interior 20, away from the interior surface 78 of the sidewall 76. In other words, pin 82 is rod-like in shape and provides a small circular structure on which the connecting feature 106 of the pawl 100 can attach to the sidewall 76.

In the arrangement shown, as one example, sidewall 76 of the clamp 70 also includes a cam surface 84. In the arrangement shown, as one example, this cam surface 84 is located along the lower end and or adjacent the bottom 74. In the arrangement shown, as one example, cam surface 84 is shaped generally like rotor 102 of the pawl 100 such that pawl 100 can rotate and/or move into and out of the hollow interior 20 without coming into contact with the cam surface 84. In the arrangement shown, as one example, the cam surface 84 is shaped such that the cam surface 84 does not contact the rotor 102 of the pawl 100 as the rotor 102 of the pawl 100 moves into and/or out of the hollow interior 20. However, it is hereby contemplated that the cam surface may cause friction with the rotor 102 of the pawl 100 such that the rotor 102 of the pawl 100 is slowed and/or subject to rigidity of motion by the cam surface 84.

In the arrangement shown, as one example, clamp 70 also includes a connecting feature 86. Connecting feature 86 may be formed of any suitable size, shape, and design and is configured to create a feature with which system 10 can be connected to a firearm and/or other trigger activated device. In the arrangement shown, as one example, connecting feature 86 extends perpendicularly from the top portion of sidewall 76. In this way connecting feature acts as an arm or attachment means by which the housing 30 can be operably attached to a trigger guard or other feature of a trigger activated device.

In the arrangement shown, as one example, clamp 70 includes a plurality of attachment features 88. Attachment features 88 are formed of any suitable size, shape, and design and are configured such that the clamp 70 can be easily attached to the housing 30. In the arrangement shown, as one example, attachment features 88 are found at the bottom 74 and/or bottom portion of the sidewall 76 of clamp 70. In the arrangement shown, as one example, attachment features 88 include a small boring through the width of sidewall 76 of clamp 70. In this way a screw or other threaded attachment means can be used to attach the clamp 70 to the housing 30 by using a single screw and/or other threaded device. However, other attachment means and/or attachment features 88 which allow for quickly and easily attaching and detaching the clamp 70 from the housing 30 are hereby contemplated for use.

In the arrangement shown, as one example, the clamp 70 is made from a single monolithic component. However, multiple operably connected components are hereby contemplated for use which may be connected by adhesion, jointing, fastening, and the like are hereby contemplated for use. In the arrangement shown, as one example, the clamp 70 is made from a durable polymer. However, other materials which are adequate for a clamp 70 are hereby contemplated for use. As an example, other materials may include a metal, a composite, an alloy, carbon fiber, polymers, enhanced polymers, pvc, ornamented wood, any combination thereof, and the like. Furthermore, various designs and shapes of the clamp 70 are hereby contemplated for use. Various designs and shapes of housing are necessary to adapt to various shapes of trigger activated devices.

Pawl:

In the arrangement shown, as one example, system 10 includes a pawl 100. Pawl 100 may be formed of any suitable size, shape, and design and is configured to rotate about an axis such that parts of the pawl 100 extend out of the hollow interior 20 of system 10 in a way that parts of the pawl 100 obstruct the movement of a trigger when a trigger activated device is pointed downward. In other words, the pawl 100 is configured such that it will restrict a trigger from activating by obstructing the trigger activation path as well as allow a trigger to activate by moving out of the trigger activated path.

In the arrangement shown, as one example, the pawl 100 includes at least one rotor 102, the at least one rotor having a cam surface 104, a rod 106, and at least one attachment feature 108, among other components.

In the arrangement shown, as one example, the pawl 100 includes at least one rotor 102. The at least one rotor 102 is formed of any suitable size, shape and design and is configured to provide a weight and a rotation about an axis, which in turn forces the rod 106 to move rotationally from the hollow interior 20 of the system 10 to the exterior of system 10 and into the trigger activation path, such that the rod 106 blocks the trigger activation path.

In the arrangement shown as one example, rotor is a weighted hub in an asymmetrical shape such that most of the weight is on one side of the axis plane of the axis of rotation of the rotor 102. In other words, more weight is on one side of the axis of rotation such that gravitational forces cause the rotor 102 to rotate when shifted. This offset in the center of gravity causes the rotor to move into and out of the hollow interior 20 of system 10. In the arrangement shown, as one example, rotor 102 has a cam surface 104. Cam surface 104 may be formed of any suitable size, shape and design and is configured to move into and out of the hollow interior 20 of system 10. In one arrangement, as is shown, the cam surface 104 of the at least one rotor 102 does not engage the cam surface 84 of the clamp 70 or the cam surface 44 of the housing 30. However, in an alternative arrangement, the cam surface 104 of the rotor 102 may be sized, shaped, and designed to engage other surfaces such that a friction is created which slows or causes movement to become more restricted. In this way, a more rigid movement can be created, which has more friction.

In the arrangement shown, as one example, pawl 100 includes at least one attachment feature 108. Attachment features 108 are formed of any suitable size, shape, and design and are configured such that the pawl 100 can be easily attached to the housing 30 and the clamp 70. In the arrangement shown, as one example, attachment features 108 are found at the sides and/or ends of the pawl 100. In the arrangement shown, as one example, attachment features 108 include a small circular mount which can be mounted onto the pin 42 of the housing 30 and the pin 82 of the clamp 70. In this way, the pawl 100 is still free to rotate, and rotate about the pins 42/82 with the pins 42/82 becoming the center or rotation. This means the attachment features 108 can be used to attach to the clamp 70 and to the housing 30 quickly and without inhibiting function of the pawl 100. However, other attachment means and/or attachment features 108 which allow for quickly and easily attaching and detaching to the clamp 70 and to the housing 30 are hereby contemplated for use. In another arrangement, as is hereby contemplated for use, the pawl 100 may be attached to only the clamp 70 or only the housing 30. In another arrangement, as is hereby contemplated for use, the pawl 100 may be permanently affixed to the housing 30 and/or the clamp 70.

In this alternative arrangement, the rotor 102 and/or other features of the pawl 100 would be free to rotate.

In the arrangement shown, as one example, the pawl 100 is made from a single monolithic component. However, multiple operably connected components are hereby contemplated for use which may be connected by adhesion, jointing, fastening, and the like are hereby contemplated for use. In the arrangement shown, as one example, pawl 100 is made from a durable polymer. However, other materials which are adequate for a pawl 100 are hereby contemplated for use. As an example, other materials may include a metal, a composite, an alloy, carbon fiber, polymers, enhanced polymers, pvc, ornamented wood, any combination thereof, and the like. Furthermore, various designs and shapes of the pawl 100 are hereby contemplated for use. Various designs and shapes of housing are necessary to adapt to various shapes of trigger activated devices.

Other components of system 10 are hereby contemplated for use. Other components and/or features of system 10 may include an attachment screw 120 or attachment feature 120, a trigger activation path 122, a pawl swing path 124 and/or pawl rotation path 124, a power source, a microprocessor, a memory, a plurality of sensors, an indicator 134 and/or a plurality of indicators 134, a trigger activated apparatus 136, a firearm 138, a trigger 140, and a projectile.

Alternative Embodiment:

In the arrangement shown, as one example, the system 10 presented herein includes a power source and a biometric sensor. The biometric sensor requires a fingerprint to disengage and/or engage the trigger safety mechanism. In this way, the trigger safety system can be activated and deactivated by only a single user or users with authorization. In this way, only a single user or designated set of users can activate and user the trigger activated device.

Additionally, an in this arrangement, the system may include a microprocessor, microcontroller, transceiver, memory, and the like so that the device can communicate with a phone application. Historical data related to the activation and deactivation of the safety device can be tracked. Additionally, in another embodiment a sensor is located such that it can detect movement of a trigger. In this way, historical uses of the trigger can be tracked. Additionally, along with GPS (global positioning satellites), the deactivation, activation, and use of the trigger safety system and trigger activated device can be tracked.

Additionally, and in the arrangement herein, and an alternative embodiment, a button may be included. In an alternative embodiment, the button feature can activate and deactivate the trigger safety system. In this way, the button feature can activate the trigger safety feature no matter the orientation of the trigger safety device. In this way, the button can prevent the trigger activated device from firing even if the trigger activated device is oriented horizontally. Additionally, and in an alternative embodiment, the biometric sensor activation is required to activate and/or deactivate the button feature such that the button feature cannot be activated or deactivated without the triggering of the biometric sensor, in correspondence with the button feature.

Additionally, in the alternative embodiment discussed herein, but biometric sensor is a fingerprint sensor. In this way, a fingerprint of a particular user is required to deactivate the safety feature. In this way, the trigger safety device cannot be activated and/or deactivated without the proper fingerprint recognition. While a fingerprint is hereby contemplated in this alternative embodiment, other biometric types are also hereby contemplated for use, including but not limited to, deoxyribonucleic acid (DNA), and other biometric screening methods which identify a unique user.

In Operation/Method of Use:

The disclosure presented herein uses a weighted mechanism that can be attached and/or removed from and/or fit and/or retrofit to any firearm and/or other trigger mechanism. The disclosure presented herein uses a gravity activated weighting system to block the trigger from movement in the direction which would activate the discharge of a firearm and/or other trigger powered mechanism.

When the handgun, firearm, and/or trigger activated mechanism is pointed downward and/or when the mechanism is placed in a holster or other holding/securing apparatus, a weighted system is activated by gravity moving a blocker and/or other obstruction into the path of the trigger. This prevents the trigger from being able to actuate because the weighted mechanism obstructs the trigger activation path.

Once the handgun, firearm, and/or trigger activated mechanism is returned to a horizontal and/or near horizontal position the safety mechanism is activated my gravity and/or voice and/or biometrics to move out of the trigger activation path. Thus, the safety mechanism allows the handgun, firearm, and/or trigger activated mechanism to discharge. In other words, the safety mechanism clears the path of trigger activation such that the trigger can activate and discharge the handgun, firearm, and/or trigger activated mechanism. This allows the handgun, firearm, and/or trigger activated mechanism to be used when needed and/or when in a horizontal and/or near horizontal position.

Various angles of activation and/or deactivation are hereby contemplated for use. Angles of activation may be at 0 degrees; 0 degrees being horizontal. Other angles of activation may be 0-10 degrees, 0-20 degrees, 0-30 degrees, 0-45 degrees, 0-60 degrees, 0-70 degrees, or 0-80 degrees, and/or 0-89 degrees. Other angles of activation may be 90 degrees if desired, more than 90 degrees, less than 0 degrees, and/or other desired planes or directions. Angles of inactivation may be 90 degrees, with 90 degrees being the trigger activated device being pointed directly at the ground. Other angles of inactivation may be 80-90 degrees, 70-90 degrees, 60-90 degrees, 45-90 degrees, more of an angle than 90 degrees, and or less than 45 degrees.

The safety mechanism is capable of adapting to or being retrofit on any firearm, handgun, or device with a trigger activation pathway. The mechanical and electronic configuration is capable of fully housing all mechanics, electronics, and power sources. Power sources may be in the form of batteries and or other power sources. The housing for the entire device can be housed within the trigger activation pathway and/or near the trigger activation pathway. In the voice activated version, the housing contains a microphone which is capable of recognizing the voice of only a single person, or group of approved individuals. In the biometric version, the device is capable of recognizing fingerprints and/or dna. In this way, the housing would also contain a microprocessor, a sensor, and a memory, among other components. Although, the safety mechanism is designed such that it activates and deactivates without human intervention, voice, or biometric activation features in addition to gravity activation features are hereby contemplated for use. Other versions of use include, but are not limited to, a trigger safety mechanism which, in addition to gravitational forces, is enhanced by a biometric sensor, dna sensor, voice sensor, and or other detection method of identifying the user. In this way, a microprocessor, memory, USB port (for programming and/or charging), software, and/or other components such as indicators are hereby contemplated for use.

It will be appreciated by those skilled in the art that other various modifications could be made to the device without parting from the spirit and scope of this disclosure. All such modifications and changes fall within the scope of the claims and are intended to be covered thereby.

What is claimed:

1. A trigger safety device, comprising:
a housing;
the housing having plurality of attachment features;
a pawl;
the pawl having a rotor;
the pawl having attachment features which attach the pawl to the housing;
wherein the pawl is rotatably attached to the housing;
the pawl having a blocking device;
a clamp;
the clamp having attachment features which attach the clamp to the housing;
wherein the trigger safety device can be retrofit onto a trigger activated device;
wherein the blocking device can prevent activation of the trigger activated device.

2. The trigger safety system of claim 1, further comprising:
wherein the blocking device blocks a trigger of the trigger activated device when the trigger activated device is pointed downwards.

3. The trigger safety system of claim 1, further comprising:
a trigger activation pathway.

4. The trigger safety system of claim 1, further comprising:
the rotor having a cam surface;
wherein the cam surface of the rotor provides for a weighted swing which spins the pawl about an axis due to a gravitational force activation.

5. The trigger safety system of claim 1, further comprising:
a power source;
wherein the power source is located within the housing;
wherein the power source is a plurality of batteries;
wherein the power source provides electrical power to components of the trigger safety system.

6. The trigger safety system of claim 1, further comprising:
a microprocessor;
a memory;
wherein the microprocessor and the memory track data;
wherein the data being tracked includes engagement and disengagement events of the trigger safety system.

7. The trigger safety system of claim 1, further comprising:
a sensor.

8. The trigger safety system of claim 1, further comprising:
a transceiver.

9. The trigger safety system of claim 1, further comprising:
an indicator;
wherein the indicator indicates to a user whether or not the trigger safety system is in an engaged position;
wherein the engaged position is the position in which the trigger safety system is preventing activation of the trigger activated device.

10. The trigger safety system of claim 1, further comprising:
an indicator;
wherein the indicator indicates to a user whether or not the trigger safety system is in an engaged position;
wherein the engaged position is the position in which the trigger safety system is preventing activation of the trigger activated device;
wherein the indicator indicates to a user whether the trigger safety system is in a disengaged position;
wherein the disengaged position is the position in which the trigger safety system is allowing activation of the trigger activated device.

11. The trigger safety system of claim 1, further comprising:
a biometric sensor;
wherein the biometric sensor detects finger print information of a user;
a disengaged position;
wherein the disengaged position is the position in which the trigger safety system is preventing activation of the trigger activated device;
wherein the biometric sensor moves the trigger safety device to the disengaged position when the user is recognized;
wherein the biometric sensor prevents moving the trigger safety device to the disengaged position when the user is not recognized.

12. The trigger safety system of claim 1, further comprising:
a biometric sensor;
wherein activation of the biometric sensor is required to disengage the trigger safety system;
wherein activation is a positive identification of a user by the biometric sensor.

13. A trigger safety system, comprising:
a housing;
the housing having plurality of attachment features;
a pawl;
the pawl having a rotor;
the pawl having attachment features which attach the pawl to the housing;
wherein the pawl is rotatably attached to the housing;
the pawl having a blocker;
a clamp;
the clamp having attachment features which attach the clamp to the housing;
wherein the trigger safety device can be retrofit onto a trigger activated device;
wherein the blocker impairs the ability of the trigger activated device to engage;
a button;
wherein the activation of the button causes the blocker to move into an engaged position such that no matter the orientation of the device, the trigger of the trigger activated device can not be activated;
wherein the engaged position is the position in which the trigger safety system is preventing activation of the trigger activated device.

14. The trigger safety system of claim 13, further comprising:
wherein pressing the button cause the trigger safety system to deactivate the blocker such that the blocker is in a disengaged position independent of the orientation of the trigger activated device;

wherein the disengaged position is the position in which the trigger safety system is allowing activation of the trigger activated device.

15. The trigger safety system of claim 13, further comprising:

a biometric sensor;

wherein activation of the biometric sensor is required to engage the button;

wherein activation is a positive identification of a user by the biometric sensor.

16. The trigger safety system of claim 13, further comprising:

a biometric sensor;

wherein activation of the biometric sensor is required to disengage the button;

wherein activation is a positive identification of a user by the biometric sensor.

17. The trigger safety system of claim 13, further comprising:

a biometric sensor;

wherein activation of the biometric sensor is required to engage the button;

wherein activation of the biometric sensor is required to disengage the button;

wherein activation is a positive identification of a user by the biometric sensor.

18. A method of practicing safe handling of a trigger activated device, the steps comprising:

providing a trigger activated device having a trigger and a trigger activation pathway;

providing a trigger safety system having a housing and a pawl;

attaching the trigger safety system to the trigger activated device by use of a clamp of the trigger safety system;

orienting the trigger activated device such that the trigger safety system engages the trigger activated device such that the trigger cannot pass into the trigger activation pathway, due to a gravitational force which causes a blocker of the pawl to prevent the trigger of the trigger activated device from moving through the trigger activated pathway; wherein orienting the trigger activation device is pointing the device downwards.

19. The method of practicing safe handling of a trigger activated device of claim 18, further comprising the steps:

providing the trigger safety system having a biometric sensor;

pressing a fingerprint against the biometric sensor of the trigger safety system;

activating the trigger safety system such that the trigger of the trigger activated device cannot engage; wherein the engaged position is the position in which the trigger safety system is preventing activation of the trigger activated device.

* * * * *